United States Patent [19]

O'Donnell et al.

[11] 4,149,966

[45] Apr. 17, 1979

[54] METHOD OF REMOVING ELEMENTAL SULFUR FROM HYDROCARBON FUEL

[76] Inventors: Joseph P. O'Donnell, 1461 Lakeshore Rd.; John B. Gilbert, 899 Cathcart Blvd., both of Sarnia, Ontario, Canada

[21] Appl. No.: 918,108

[22] Filed: Jun. 22, 1978

[51] Int. Cl.[2] ..... C10G 29/06; C10G 25/00

[52] U.S. Cl. ..... 208/237; 208/246; 208/301

[58] Field of Search ..... 208/246, 237, 301

[56] References Cited

U.S. PATENT DOCUMENTS

| | | | |
|---|---|---|---|
| 2,271,665 | 2/1942 | Schulze et al. | 208/246 |
| 2,276,526 | 3/1942 | Von Fuchs et al. | 208/246 |
| 2,693,443 | 11/1954 | Waddell et al. | 208/237 |
| 2,768,932 | 10/1956 | Richard et al. | 208/246 |
| 3,051,646 | 8/1962 | Brooke | 208/301 |

*Primary Examiner*—George Crasanakis

*Attorney, Agent, or Firm*—Eugene Zagarella, Jr.

[57] ABSTRACT

This invention relates to an improved method of removing elemental sulfur from refined hydrocarbon fuels comprising adding an organo mercaptan compound and a copper compound capable of forming a soluble copper complex with said mercaptan and said sulfur and contacting said fuel with an adsorbent material to remove the copper complex and substantially all of said elemental sulfur.

10 Claims, No Drawings

METHOD OF REMOVING ELEMENTAL SULFUR FROM HYDROCARBON FUEL

BACKGROUND OF THE INVENTION

This invention relates to the method for reducing corrosion in refined hydrocarbon fuels by removing elemental sulfur from said fuel. More particularly, this invention involves an improved method of reducing corrosion in refined hydrocarbon fuels by adding an organo mercaptan compound and a copper compound capable of forming a soluble copper complex with any mercaptan and elemental sulfur present in the fuel and contacting said fuel with an adsorbent material to remove the copper complex and substantially all of said elemental sulfur.

The problems associated with the presence of sulfur compounds, and particularly elemental sulfur and mercaptans, in hydrocarbon fuels has been known for a long time. Various techniques have been developed for removing said sulfur materials from hydrocarbon compositions. Such techniques include a process for treating petroleum oil by passing vapors through a mixture of an anhydrous silicate and a salt of a metal having an affinity for the sulfur compounds of the oil (such as malachite, azurite or cuprite) as disclosed in U.s. Pat. No. 1,587,491 issued to R. Cross on June 1, 1926. Another patent to R. Cross, U.S. Pat. No. 1,840,158 issued on Jan. 5, 1932 discloses a two-stage process for sulfur compound removal from light hydrocarbons wherein the first stage comprises treating the hydrocarbons under pressure in vapor phase with a metallic compound such as copper or other metal having an affinity for sulfur and then through a subsequent treating zone comprising a solid adsorbent material such as clay. U.S. Pat. No. 2,028,995 issued to F. M. Rogers on Jan. 28, 1936 discloses a process for desulfurizing petroleum oils using solid adsorbent catalytic materials of the clay type at high temperatures to convert difficult to remove sulfur compounds into easily removable sulfur compounds, U.S. Pat. No. 2,276,526 issued to G. H. von Fuchs et al on Mar. 17, 1942 discloses a process for removal of mercaptans without forming disulfides as well as removal of disulfides originally present by treatment with cuprous oxide. U.S. Pat. No. 2,496,536 issued to C. O. Hoover on Feb. 7, 1950 discloses a process in which elemental sulfur and sulfur compounds such as mercaptans, bisulfides, sulfides and hydrogen sulfide are removed from petroleum distillates by contacting vapors with the copper salt of an alkyl or aromatic carboxylic acid, such as copper naphthenate. Another technique is disclosed in U.S. Pat. No. 2,768,932 issued to G. P. Richard et al on Oct. 30, 1956 and involves a process for the further desulfurization of hydrofined petroleum distillates by treating said distillates in vapor phase with finely divided metallic copper, copper containing alloys or cupric oxide. U.S. Pat. No. 3,378,484 issued to J. M. Ferrara et al. on Apr. 16, 1968 discloses a method for removing mercaptans from liquid hydrocarbons by bringing the hydrocarbons into contact with a finely divided particulate ion exchange material containing a metallic element such as copper, mercury, silver, lead, iron etc.

The above-noted patents all disclose the well known desirability of removing sulfur compounds from petroleum hydrocarbons and one of the techniques for accomplishing this involves contacting the hydrocarbon composition with a metallic compound such as copper.

Now it has been found that the amount of elemental sulfur and corrosion in refined hydrocarbon fuels can be significantly reduced when small effective amounts of organo mercaptan compounds are added to the fuel in combination with a copper compound capable of forming a soluble copper complex with any mercaptan and elemental sulfur present in the fuel. The sulfur and complex are removed in a subsequent step wherein the fuel is contacted with an adsorbent material.

This method wherein mercaptan compound is added to the fuel composition is somewhat contrary to the generally known techniques which indicate the necessity to remove mercaptan from the fuel and do not suggest the addition of a mercaptan to aid in removal of elemental sulfur.

DETAILED DESCRIPTION OF THE INVENTION

This invention involves a method for reducing corrosion in refined hydrocarbon fuels and comprises the addition of an organo mercaptan compound and a copper compound capable of forming a soluble copper complex with any mercaptan and elemental sulfur present in the fuel and thereafter contacting said fuel with an adsorbent material to remove the copper complex and substantially all of said elemental sulfur.

The organo mercaptan compounds useful in the present invention include a wide variety of compounds having the general formula RSH, where R represents an organic radical which may be an alkyl, alkenyl, cycloalkyl, cycloalkenyl, aryl, aralkyl and alkaryl or 1 to 30 carbon atoms and preferably 1 to 20 carbon atoms. Thus, the radical may, for example, be methyl, ethyl, n-propyl, i-propyl, n-butyl, i-butyl, sec-butyl, tert-butyl, amyl, n-octyl, decyl, dodecyl, octadecyl, phenyl, butylphenyl, napthyl, cyclohexyl, methylcyclopentyl, propenyl, butenyl, etc.

The copper compound useful in the method of this invention may be any copper compound capable of forming a soluble copper complex with mercaptan and elemental sulfur present in the fuel composition. More particularly, the copper compound may be copper carbonate, copper naphthenate, copper oxide and metallic copper, and preferably a copper naphthenate. Copper carbonate is another preferred copper compound particularly when a fixed bed application is used.

The adsorbent material may be any material having adsorbent properties such as clay or claylike materials and particularly the highly adsorptive clays such as attapulgus clay, bauxite, fullers earth including Floridin, and any hydrous aluminum silicate having the characteristics of the highly adsorptive clays such as Bentonite. In addition to the adsorptive clays and hydrous aluminum silicates, adsorptive carbon, chemically prepared silica or any other adsorptive earthy materials may be used.

The fuel composition of this invention may be any of a wide variety of petroleum hydrocarbon fuels and particularly refined hydrocarbon fuels, such as gasoline, jet fuel, kerosene and compositions comprising mixtures of hydrocarbons of various types including straight and branched chain paraffins, olefins, aromatics and naphthenic hydrocarbons.

In general, the method of this invention will involve the addition of an effective amount of the organo mercaptan compound and the copper compound to allow a copper complex to form with substantially all of the elemental sulfur present in the fuel composition. Generally, the amount of organo mercaptan compound and copper compound used in the method of this invention will be about equal to the amount of elemental sulfur in the fuel composition. More particularly, from about 0.001 to about 10 moles of organo mercaptan compound per mole of sulfur, preferably about 0.01 to about 3 moles of organo mercaptan compound per mole of sulfur and more preferably about 1 mole of organo mercaptan compound per mole of sulfur will be used. The amount of copper compound utilized in this invention will vary from about 0.001 to about 10 moles of copper compound per mole of sulfur, preferably about 0.01 to about 3 moles of copper compound per mole of sulfur and more preferably about 1 mole of copper compound per mole of sulfur.

Having thus broadly and specifically described the present invention, it is believed that the same will become even more apparent by reference to the following examples which are included for the purposes of illustration and which are in no way intended to limit the scope of the invention.

EXAMPLE 1

A hydrocarbon turbo fuel (virgin distillate, spec. grav. 0.82, 50% distilled off at 450° F.) having a small amount of native mercaptan was analyzed for reactive sulfur and found to have 10.0 ppm (by Mercury No.) and a silver corrosion rating of 4 (ASTM-D-130).

The same hydrocarbon fuel had a reactive sulfur of 10.0 ppm and silver corrosion rating of 4 after it was clay treated, and a similar sample in which copper naphthenate (8 mg. metallic Cu/liter) was added before clay treating had a reactive sulfur of 6.2 ppm and a silver corrosion rating of 2.0.

A sample of the same hydrocarbon fuel was combined with 100 mg/liter of phenyl mercaptan and copper naphthenate (8 mg. metallic Cu/liter) and then clay treated and found to have a reactive sulfur of 3.8 ppm and a silver corrosion rating of 0.

Another sample of the same hydrocarbon fuel was combined with an excess of solid $CuCO_3$ before clay treating and found to have a reactive sulfur of 11.5 and a silver corrosion rating of 3. A similar sample with 100 mg/l. of phenyl mercaptan in addition to the solid $CuCO_3$ added thereto was clay treated and resulted in a reactive sulfur of 5.0 ppm and a silver corrosion rating of 0.

EXAMPLE 2

A hydrofined hydrocarbon turbo fuel (spec. gravity 0.75, 50% distilled off at 375° F.), which contained no mercaptan after refinery processing was analyzed for reactive sulfur and found to have 7.2 ppm (by Mercury No.) and a silver corrosion rating of 4 (ASTM-D-130).

An identical sample of hydrocarbon fuel was clay treated and found to have a reactive sulfur of 7.2 ppm and silver corrosion rating of 4.

Another identical sample of hydrocarbon fuel was combined with copper naphthenate (8 mg. metallic Cu/liter) and then clay treated and found to have a reactive sulfur of 6.4 ppm and a silver corrosion rating of 2.

A sample of the same hydrocarbon fuel was combined with 100 mg/l. of phenyl mercaptan and copper naphthenate (8 mg. metallic Cu/liter) and then clay treated and found to have a reactive sulfur of 4.1 ppm and a silver corrosion rating of 0.

Another sample of the same hydrocarbon fuel was combined with an excess of solid $CuCO_3$ before clay treating and found to have a reactive sulfur of 11.5 and a silver corrosion rating of 4. A similar sample with 100 mg/l. of phenyl mercaptan in addition to the solid $CuCO_3$ added thereto was clay treated and resulted in a reactive sulfur of 1.3 ppm and a silver corrosion rating of 0.

It will be seen from the above examples that the addition of an organo mercaptan in combination with a copper compound resulted in a significant reduction in sulfur content and corrosion.

What is claimed is:

1. A method for reducing corrosion in a hydrocarbon fuel by removing elemental sulfur from said hydrocarbon composition comprising adding to said fuel an effective amount of an organo mercaptan compound and a copper compound capable of forming a soluble copper complex with said mercaptan and sulfur and contacting said fuel with an absorbent material to remove substantially all of said complex and elemental sulfur from said fuel.

2. The method of claim 1 wherein from about 0.001 to about 10 moles of said organo mercaptan compound and from about 0.001 to about 10 moles of said copper compound per mole of elemental sulfur in the fuel compositon are used.

3. The method of claim 2 wherein said copper compound is selected from the group consisting of copper carbonate, copper naphthenate, copper oxide and metallic copper.

4. The method of claim 3 wherein said organo mercaptan compound has the formula RSH where R represents an organic radical which may be an alkyl, alkenyl, cycloalkyl, cycloalkenyl, aryl, aralkyl and alkaryl group having from 1 to 30 carbon atoms.

5. The method of claim 4 wherein said adsorbent material is an absorptive clay.

6. The method of claim 1 wherein from about 0.01 to about 3 moles of said organo mercaptan compound and from about 0.01 to about 10 moles of said copper compound per mole of elemental sulfur in the fuel composition are used.

7. The method of claim 6 wherein said copper compound is selected from the group consisting of copper carbonate, copper naphthenate, copper oxide and metallic copper.

8. The method of claim 7 wherein said organo mercaptan compound has the formula RSH where R represents an organic radical which may be an alkyl, alkenyl, cycloalkyl, cycloalkenyl, aryl, aralkyl, alkaryl group having from 1 to 30 carbon atoms.

9. The method of claim 8 wherein said R group has from 1 to 20 carbon atoms.

10. The method of claim 9 wherein said organo mercaptan compound is phenyl mercaptan and said copper compound is copper naphthenate.

* * * * *